United States Patent [19]

Burkett

[11] 3,987,970

[45] Oct. 26, 1976

[54] CENTRIFUGAL MILL

[76] Inventor: Albert L. Burkett, 3700 E. Bellevue, Apt. 313, Tucson, Ariz. 85716

[22] Filed: June 16, 1975

[21] Appl. No.: 586,954

[52] U.S. Cl. ..... 241/43; 241/154; 241/186.2

[51] Int. Cl.[2] ..... B02C 23/38

[58] Field of Search ..... 241/43, 154, 186 R, 241/186.2, 188 R, 275

[56] References Cited

UNITED STATES PATENTS

| | | | |
|---|---|---|---|
| 1,048,869 | 12/1912 | Pitcairn | 241/43 |
| 1,636,033 | 7/1927 | Agnew | 241/188 |
| 2,847,168 | 8/1958 | Smiley | 241/186.2 |
| 2,940,678 | 6/1960 | Sharpe et al. | 241/275 |
| 3,065,919 | 11/1962 | Burkett et al. | 241/161 |
| 3,160,354 | 12/1964 | Burkett | 241/275 |

*Primary Examiner*—Granville Y. Custer, Jr.
*Attorney, Agent, or Firm*—Herbert E. Haynes, Jr.

[57] ABSTRACT

A centrifugal mill for treating refuse is fed so that the refuse comes into contact with a pre-breaker mechanism and subsequently into contact with a series of comminution mechanisms. Feeding of the refuse is simultaneously accomplished with the injection of a fluid carrier medium such as air, water, aqueous sewage, and the like which is blended with the refuse. The mill is provided with mechanisms for adjustably controlling the through-put rate of the refuse and the fluid carrier medium.

13 Claims, 7 Drawing Figures

CENTRIFUGAL MILL

BACKGROUND OF THE INVENTION

1. Field of the Invention

This invention relates to refuse treatment and more particularly to a centrifugal mill for treatment of refuse.

2. Description of the Prior Art

Refuse such as garbage, rubbish, and other solid materials from both domestic and commercial sources has for many years been collected by suitable trucks and transported to disposal locations. The disposal methods most commonly employed are burning of the refuse in suitable incinerating mechanisms and burial thereof in land fill operations.

In recent years, several factors have caused an evaluation of the above described collection and disposal techniques to be made. In the first place, changes in life style, increasing population, and the like have caused increases in the amounts of solid refuse which must be collected and disposed of. It has been estimated that approximately 220 million tons of solid refuse is collected annually in the United States at a cost which has become a tremendous financial burden which the responsible local municipalities are finding increasingly difficult to bear. Other factors of general concern are the well known pollution, health, and odor problems associated with the burning and burying techniques.

The undersirable results and high costs of the above described inefficient and antiquated methods of collection and disposal of refuse along with the wasting of reclaimable materials and the loss of a potential source of energy have spurred a search for new methods of handling such refuse. Many systems and mechanisms have been proposed and built for more efficient handling and disposal of refuse materials with some of those systems designed for the purpose of reclaiming materials, others for the production of methane gas, and still others simply for the purpose of shredding the refuse for more compaction thereof.

In any event, the relatively new systems almost without exception employ some sort of a mill or grinding mechanism for improving the handling characteristics of the refuse. In general, the mills and/or other grinding devices being employed in these newly developed and proposed systems are mechanisms which were originally designed for other purposes such as for pulverizing ore. In many instances, these prior art milling or grinding devices have been employed in the new refuse handling systems in the exact originally developed form and have not been entirely satisfactory due to the fact that they were designed to handle a completely different type of material or materials. In other instances, these prior art milling or grinding devices have been modified somewhat from their original form in an attempt to adapt those devices to the various problems of handling refuse materials, and those modified prior art mechanisms have also not proven entirely satisfactory.

As is well known, solid refuse of the type collected from residential and commercial sources may contain anything such as large cardboard boxes, paper and plastic materials, putricidable food stuffs, metal, glass, cloth, wood, and so forth. The various weights, volumns, sizes, frangibility and the like of such a variety of materials results in problems which were not heretofore encountered in the milling or grinding of specific materials such as ore.

So far as is known to me, no mill or grinding mechanism has been designed or proposed for the express purpose of handling and treating refuse materials. Therefore, in view of the above, a need exists for a new and useful centrifugal mill which is particularly adapted for the handling and treatment of refuse materials.

SUMMARY OF THE INVENTION

In accordance with the present invention, a new and useful centrifugal mill is disclosed for the handling and treatment of solid waste materials. The centrifugal mill includes a housing into which the refuse matterial is fed so as to come into contact with a pre-breaker mechanism and then subsequently move into contact with comminution mechanisms. Feeding of the refuse material is accomplished simultaneously with the injection of a fluid carrier medium which is employed for controlling the movement of the refuse materials thorugh the mill and also for treating the materials. The fluid carrier medium may be air alone, or air in conjunction with water, waste liquid hydrocarbons, aqueous sewage, and the like. If air alone is employed, the results will be a controllable through-put rate of the refuse, rudimentary air classification thereof and the production of an odor free substantially dry pulverized material. If water or an aqueous sewage is included in the fluid carrier medium, the results will be the same with the exception that the air classification will be substantially reduced, if not entirely eliminated, and the processed refuse material emerging from the mill will be contained in a pumpable slurry. The centrifugal mill is provided with means for adjustably controlling the through-put rate of the refuse material.

Accordingly, it is an object of the present invention to provide a new and improved centrifugal mill for handling and treatment of solid refuse materials.

Another object of the present invention is to provide a new end useful centrifugal mill for the handling and treatment of solid refuse materials which are fed so as to first move into contact with a pre-breaker means and subsequently move into contact with comminution means.

Another object of the present invention is to provide a new and useful centrifugal mill for handling and treatment of solid refuse materials which are processed within the mill simultaneously with a fluid carrier medium which controls movement of the refuse materials and treats those materials.

Another object of the present invention is to provide a new and useful centrifugal mill for handling and treating solid refuse materials with those materials being simultaneously fed into the mill in conjunction with a fluid carrier medium and processed therein at a controlled rate of flow.

Another object of the present invention is to provide a new and useful centrifugal mill of the above described character which expells the processed materials in a substantially dry pulverized odor free form when the injected fluid carrier medium is air.

Still another object of the present invention is to provide a new and useful centrifugal mill as described above which expells the processed materials in a pulverized odor free blended pumpable slurry when the injection fluid carrier medium is air and an aqueous solution.

The foregoing and other objects of the present invention, as well as the invention itself may be more fully understood from the following description when read in conjunction with the accompanying drawings.

DESCRIPTION OF THE PREFERRED EMBODIMENT

Figure 1:
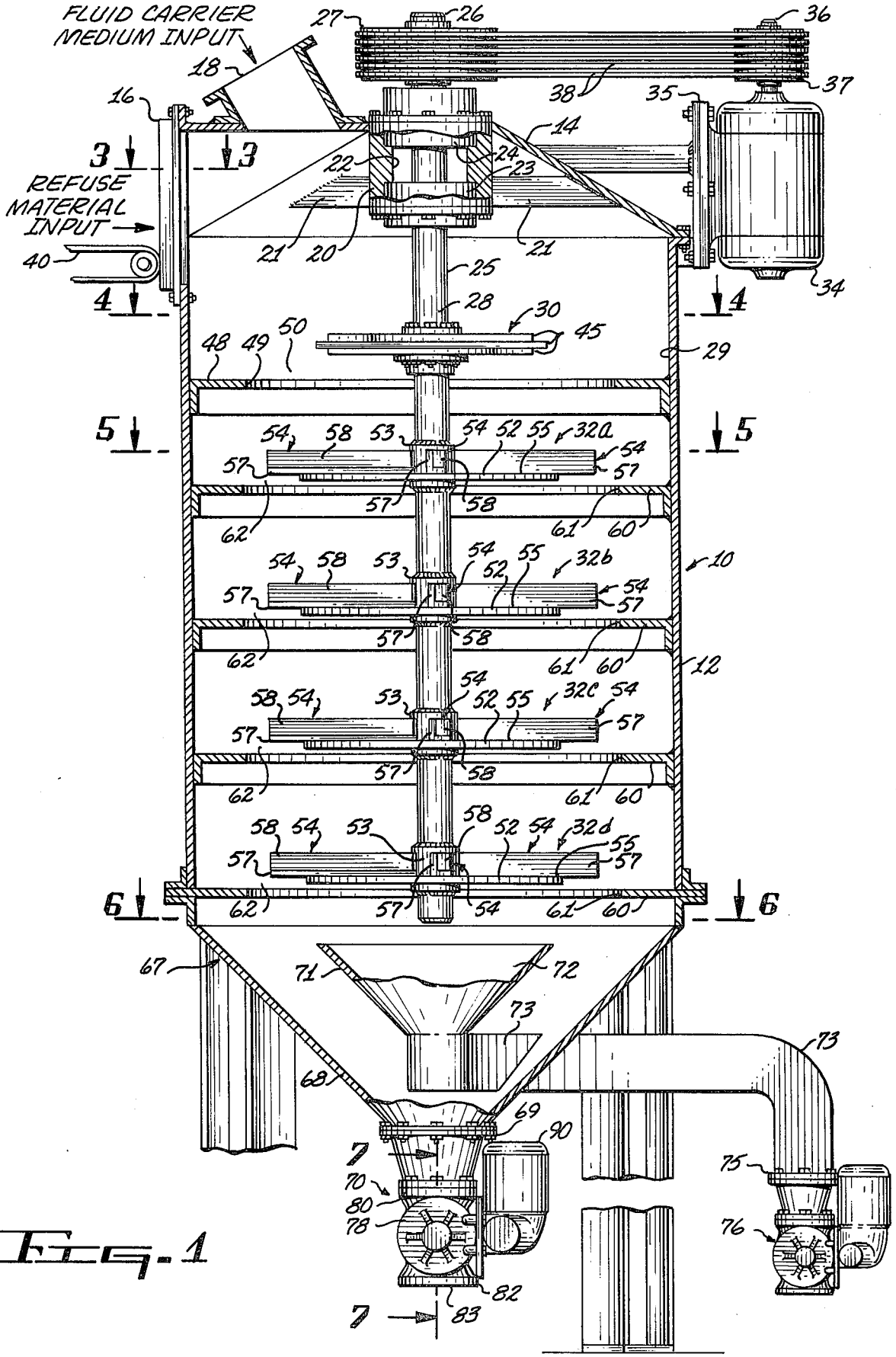
FIG. 1 is a longitudinal sectional view of the centrifugal mill of the present invention showing the various features thereof.
Figure 2:
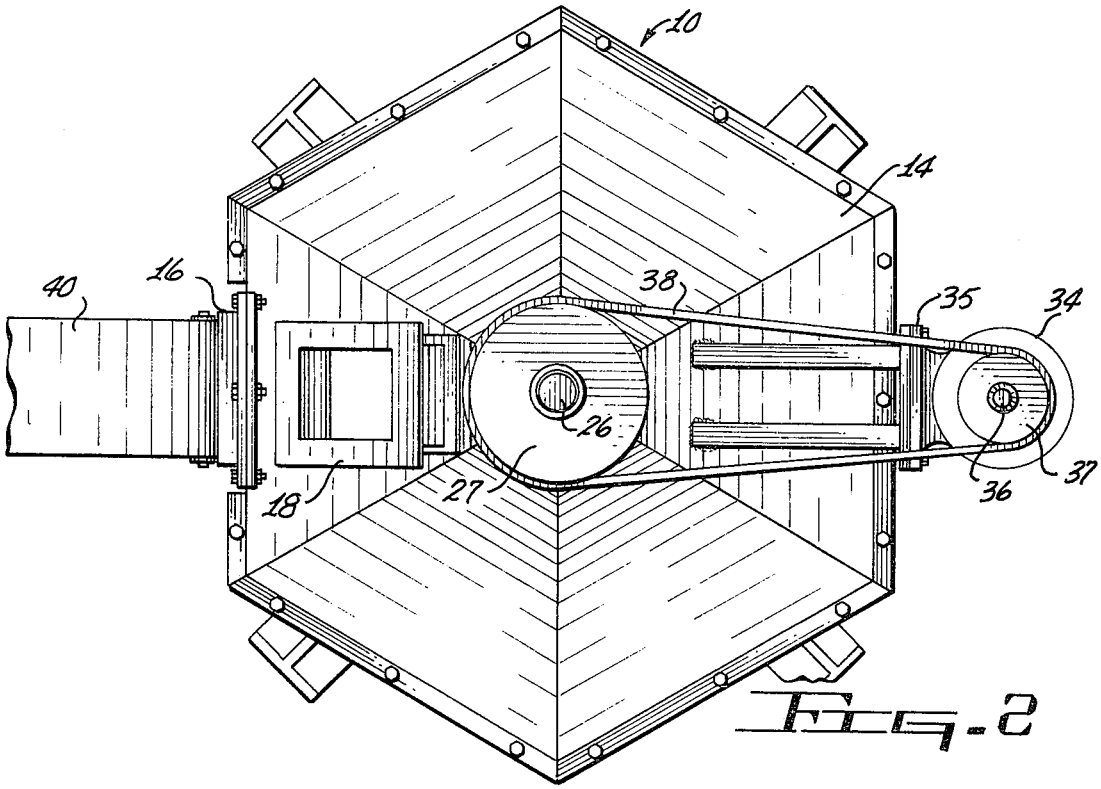
FIG. 2 is a plan view of the centrifugal mill of the present invention.

Referring more particularly to the drawings, FIG. 1 illustrates the centrifugal mill of the present invention which is indicated generally by the reference numeral 10. The mill 10 includes a housing 12 which may be cylindrical but preferrably is formed of a plurality of flat side plates 13 suitably interconnected to form a multisided configuration such as hexangular. The multisided configuration is preferred for ease of fabrication and to improve internal air flow characteristics as will become apparent as this description progresses. The housing 12 has a head section 14 with a refuse input port 16 and fluid carrier medium injection port 18 formed therein as will hereinafter be described in detail. A bearing boss 20 is centrally located in the head 14 and is supported such as by a plurality of radial beams 21 to position the boss 20 coaxially with respect to the longitudinal axis of the housing 12. The boss 20 has an axial bore 22 formed therethrough in which a spaced pair of bearings 23 and 24 are suitably mounted. A shaft 25 is rotatably mounted and suspendingly carried by the bearings 23 and 24 and has an upper end 26 which extends above the head 14 and to which a suitable driven pulley 27 is affixed. The shaft 25 is also provided with a depending end 28 which extends coaxially into the bore 29 of the housing 12 and to which the grinding and shredding means of the present invention is affixed for rotation therewith. The grinding and shredding means includes a pre-breaker means 30 and a plurality of comminution means **32*a*, 32*b*, 32*c* and 32*d*** which are mounted in axially spaced increments as will hereinafter be described.

Drive means 34 in the form of a variable speed electric motor is affixed to a suitable mounting plate 35 carried on the housing 12, and the output shaft 36 of the motor 34 has a drive pulley 37 mounted thereon. A plurality of belts 38 are employed to couple rotary motion from the drive pulley 37 of the motor 34 to the driven pulley 27 of the shaft 25.

Figure 3:
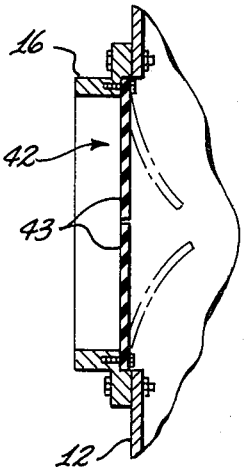
FIG. 3 is an enlarged fragmentary sectional view taken on the line 3—3 of FIG. 1.

Refuse material of all types, such as is commonly collected at residential and commercial sources, is delivered to the mill 10 by any convenient means, such as the conveyor assembly 40, and is fed into the mill 10 through the refuse input port 16. As shown in FIG. 3, the refuse input port 16 is provided with a referse flow checking means 42 in the form of a pair of normally closed deflectable flaps 43 which are forced open by the entering refuse materials and will return to the normally closed position in the absence of such a force. The reverse flow checking means 42 prevents undesirable exiting of refuse materials through the input port 16 such as could result from the impact of the pre-breaker means 30 with the refuse material. As will hereinafter be described, a fluid carrier medium is injected into the mill 10 simultaneously with the feeding of refuse material, and the reverse flow checking means 42 serves to limit the uncontrolled excaping of that medium through the input port 16.

Figure 4:
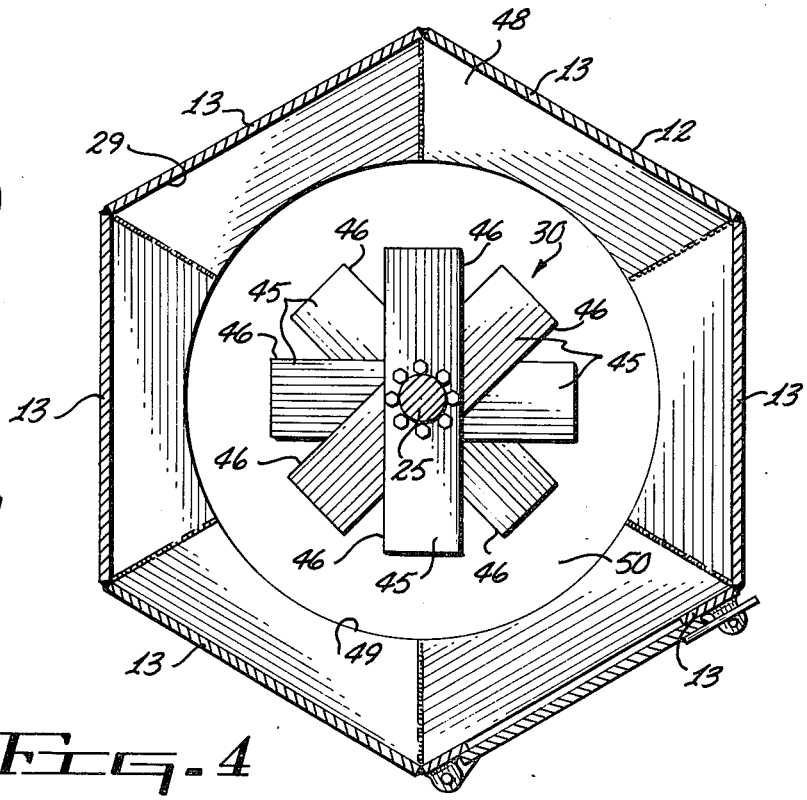
FIG. 4 is a sectional view taken on the line 4—4 of FIG. 1.

The refuse input port 16 is disposed so that entering refuse material will come into contact with the pre-breaker means 30. The pre-breaker means 30 is designed to tear open plastic garbage bags, cardboard boxes, and other relatively large containers, and also scatter and break up other frangible materials. As seen in FIGS. 1 and 4, the preferred form of the pre-breaker means 30 is a plurality of rectangularly configured metal plates 45 suitably affixed at their respective centers to the shaft 25 for rotation therewith. The plates 45 are mounted in a stacked array and are angularly radially offset with respect to each other to provide a plurality of refuse impacting edges 46. A shelf structure 48 is fixed to the bore 29 of the housing 12 proximate the pre-breaker means 30 and is disposed slightly below the path of rotation thereof. The shelf 48 is formed with a central circular opening 49 therethrough which is concentric with and of larger diameter than the peripheral dimension of the pre-breaker means 30 to provide an annular opening 50 therebetween. Refuse materials entering into the mill 10 will come into the pre-breaker means area and be impacted thereby, relatively large items will be retained in that area by the shelf 48 until the size thereof has been reduced sufficiently to allow passage downwardly through the the annular opening 50.

The refuse materials having been reduced in size by the pre-breaker means 30 as above described will move into the area of the first in a spaced series of comminution means **32*a*. Since each of the comminution means 32*a*, 32*b*, 32*c* and 32*d*** are identical structures, it should be understood that the following description relating to the first of those mechanisms also relates to the other mechanisms.

Figure 5:
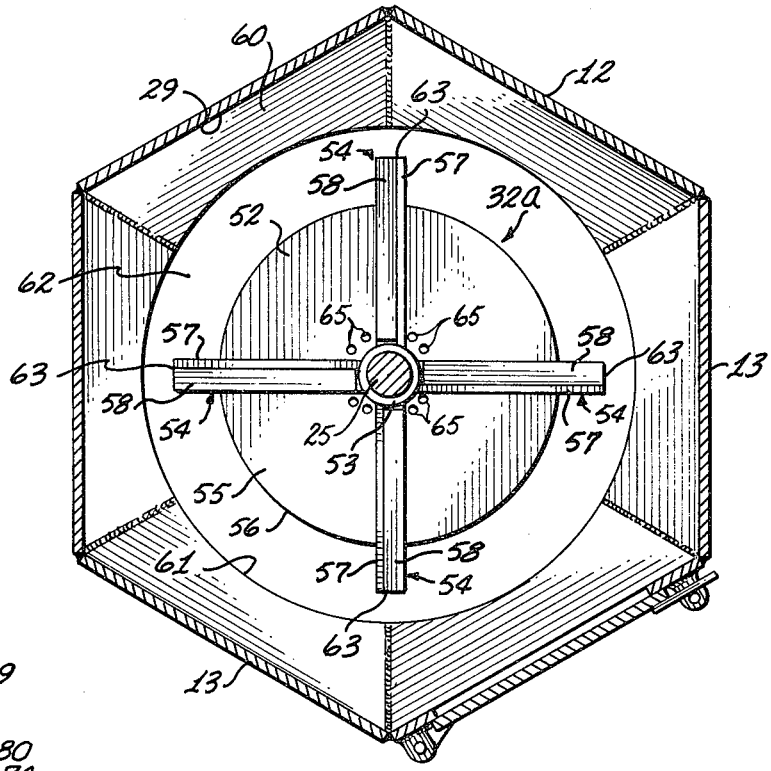
FIG. 5 is a sectional view taken on the line 5—5 of FIG. 1.

As shown in FIGS. 1 and 5, the comminution means **32*a* comprises a circular disc 52 having a central hub 53 which is suitably affixed to the shaft 25 so that the disc 52 will rotate therewith. A plurality of radially disposed striker vanes 54 are affixed to the upper surface 55 of the disc and are each configured to extend radially from the hub 53 a distance somewhat beyond the periphery 56 of the disc. Each of the striker vanes 54 are fabricated of an angle iron member 57 with a reinforcing block 58 welded or otherwise secured thereto so as to be disposed between the angularly related webs of the angle iron members 57. The blocks 58 serve as reinforcing members and also add a flywheel effect to the rotating members of the mill 10. A shelf structure 60 is fixed to the bore 29 of the housing 12 proximate the comminution means 32*a* and the shelf 60 is disposed immediately below the path of rotation thereof. The shelf 60 is provided with a centrally located circular opening 61 therethrough which is concentric with the shaft 25 and the disc 52. The opening 61 in the shelf 60 is of larger diameter than the periphery 56 of the disc 52** to provide an annular opening 62 therebetween into which the extending ends 63 of each of the striker vanes 54 project.

The disc members 52 of the comminution means 32*a*, 32*b*, 32*c* and 32*d* are provided with a plurality of apertures 65 proximate the hubs 53 thereof to relieve the negative static pressure which would otherwise occur in those areas due to rotation of the comminution means.

It may now be seen that the movement of refuse material downwardly through the mill 10 will first subject that material to the action of the pre-breaker means 30 and will subsequently subject the materials to the action of the series of comminution means 32*a* through 32*d*. When the refuse materials pass through the annular opening 62 adjacent the last comminution means 32*d*, the materials will be finely shredded and will move into the discharge section 67 of the mill 10.

The discharge section 67 of the mill 10 includes a hopper 68 which funnels the shredded materials to an outlet port 69. The outlet port 69 has a flow control means 70 connected thereto as will hereinafter be described in detail.

The discharge section 67 of the mill 10 may also include an air classifier means 71 in the form of an internally mounted hopper 72 which is concentric with the main hopper 68. In accordance with the well known principles of air classification, the internal hopper 72 will receive relatively light weight materials such as paper, plastic wrapping materials and the like which are directed thereto by air currents within the mill 10. Those relatively light weight materials will be directed downwardly in the internal hopper 72 and will emerge through a curved output duct 73 which passes through the side wall of the main hopper 68 to a location external of the mill 10. The outlet end 75 of the output duct 73 is provided with a flow control means 76 thereon which is similar to the flow control means 70 of the main hopper 68, and will also be hereinafter described in detail.

As hereinbefore mentioned, the great variety of types of materials contained in a typical amount or batch of solid refuse presents problems in the shredding and grinding thereof, with one of those problems being the processing of relatively light weight materials such as plastic wrapping materials and the like. Such materials are difficult to shred due to their tendency to "flutter" down through the milling mechanism and to "bounce" when contacted by the rotating mechanisms of the milling machine.

Therefore, it has been determined through experimentation that to effectively process those problem materials as described above, a fluid carrier medium is needed to forcefully push those materials through the mill 10. Those experiments included the use of air alone as the fluid carrier medium and use of air in conjunction with aqueous solutions such as water and aqueous sewage. The experiments all proved successful as far as the handling of the problem materials and provided an unexpected result as to the treatment of putricidable food stuffs and other odor producing materials.

The refuse materials processed in the mill 10, when that mill 10 contains suitable devices for injecting relatively large quantities of air, emerged therefrom odor free. It has been theorized that the injection of air along with the violent shredding action taking place in the mill causes a speed up in the anaerobic action of putricidable materials and those materials emerge from the mill 10 odor free due to the biochemical oxygen demand having been satisfied.

Therefore, it will be understood that when air alone is employed as the fluid carrier medium the shredded refuse will emerge from the mill 10 in a substantially dry odor free shredded form. When the fluid carrier medium is air and an aqueous liquid such as water, the shredded materials which emerge from the mill 10 will be in the form of a blended odor free pumpable slurry. When the fluid carrier medium is air in conjunction with aqueous sewage for emerging materials will be the same, i.e., a blended odor free pumpable slurry.

Injection of the fluid carrier medium into the mill 10 may be accomplished in various ways such as through the fluid carrier medium injection port provided inthe head 14 of the mill 10. Air from a remotely located source (not shown) may be fed through suitable ducting (not shown) to the port 18. An aqueous liquid may also be injected into the mill simultaneously with the air through the same injection port 18.

With the introduction into the mill of the above described fluid carrier medium, it is preferred that means be provided to control the rate of flow of materials and the carrier medium through the mill 10. The desirability of a flow rate control means will be apparent upon consideration of several factors such as the results of an excessive pressure buildup within the mill, excessively rapid air movement through the mill and the like.

If an excessive pressure buildup occurs within the mill 10, the refuse materials will be violently discharged from the discharge end 67 of the mill 10, and those materials would tend to try to exit the mill 10 through the refuse input port 16. Such exiting could occur, if an excessive pressure differential were allowed to occur, when the reverse flow checking means 42 is forced open during the input of refuse materials into the mill 10 as hereinbefore described. If an excessively rapid air movement occurs within the mill, relatively light weight materials such as the previously described problem materials, will move through the mill at too fast a rate and adequate processing will not occur.

When the fluid carrier medium includes an aqueous liquid, the discharge rate must also be controlled so that a liquid buildup within the mill 10 will not occur. such a liquid buildup could impede the rotation of the mill's shredding devices.

Therefore, the rate of flow of the refuse materials and the fluid carrier medium are controlled at a rate which is substantially equal to the input rates of the refuse and fluid carrier medium to prevent an excessive through put rate, excessive pressure buildup, and an accumulation of the processed materials and medium within the mill 10.

It is preferred that the rate of flow be adjustably contollable by employing the flow control means 70, and the flow control means 76 if the air classifer means 71 is included in the mill 10 of the present invention. The flow control means 70 and 76 are identical structures except possibly for size, therefore it will be understood that the following description relating to the flow control means 70 also relates to the flow control means 76.

Figure 7:
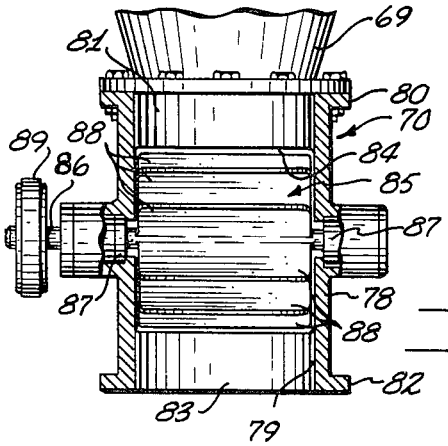
FIG. 7 is an enlarged fragmentary sectional view taken on the line 7—7 of FIG. 1.
Figure 6:
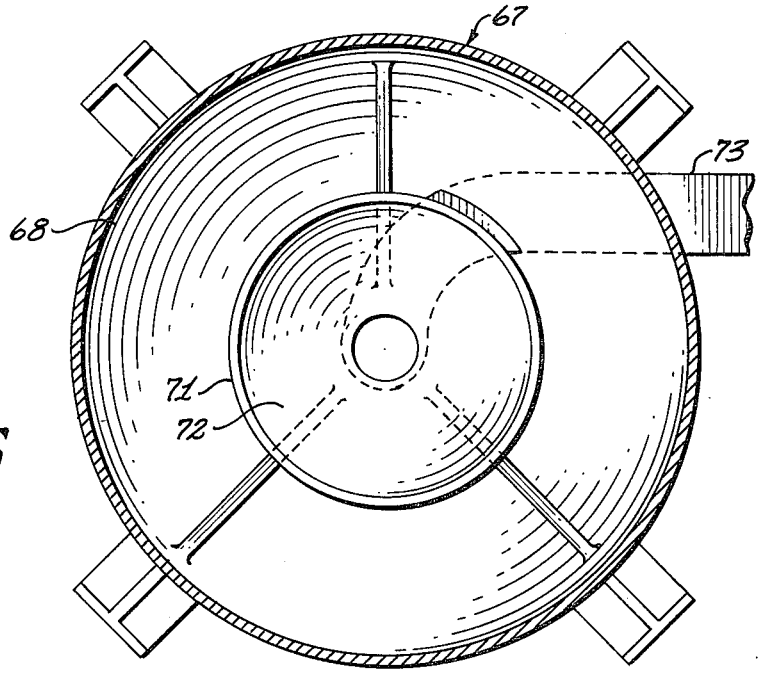
FIG. 6 is a sectional view taken on the line 6—6 of FIG. 1.

As seen in FIGS. 1 and 7, the flow control means 70 includes a housing 78 having a material passing bore 79 formed therethrough. The housing 78 has a flange 80 at the inlet end 81 of the bore 79, and that flange 80 is affixed to the outlet port 69 of the hopper 68. A similar flange 82 is provided at the outlet end 83 of the housing 78 for affixation, if desired, to a material receiving structure (not shown). A cylindrical chamber 84 is formed in the bore 79 of the housing 78 intermediate the inlet and outlet ends 81 and 83 with the longitudinal axis of the chamber 84 being transverse to the axis of the bore 79. A rotor mechanism 85 having a shaft 86 rotatably journaled in suitable bearings 87 is provided with a plurality of radially spaced vanes 88 with those vanes positioned within the chamber 84. The rotor 85 is driven by a belt 89 connected to a variable speed motor 90. The vanes 88 of the rotor 85 are sized so as to be slightly smaller than the diameter of the chamber 84, therefore, the flow rate of the processed materials and the fluid carrier medium through the bore 79 of the housing 78 will be determined by the rotational speed of the rotor.

It should be noted that although it is preferred that the mill 10 of the present invention include the above described adjustable flow control means 70 and 76, essentially the same results could be achieved with a fixed flow rate mill. This could be accomplished by fixing the input rates of the refuse material and the fluid carrier medium and calculating the outlet of the discharge section 67 accordingly. Of course, the flexibility of a fixed flow rate mill would not be as great as the preferred configuration of the mill 10.

While the principles of the invention have now been made clear in an illustrated embodiment, there will be immediately obvious to those skilled in the art, many modifications of structure, arrangements, proportions, the elements, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A centrifugal mill for shredding and grinding refuse materials, said centrifugal mill comprising:

a. a housing having a vertically disposed bore formed therethrough and a head section at the upper end thereof and a discharge section at the lower end thereof;

b. a refuse input port formed in the head section of said housing;

c. means in the head section of said housing for injecting a fluid carrier medium into the bore of said housing;

d. refuse shredding and grinding means rotatably mounted and coaxially disposed within the bore of said housing, said refuse shredding and grinding means comprising, a shaft rotatably concentrically mounted in the bore of said housing, pre-breaker means affixed to said shaft for rotation therewith, said pre-breaker means located adjacent the head section of said housing for initially impacting the refuse material and the fluid carrier medium upon feeding thereof into the bore of said housing, and at least a pair of comminution means affixed to said shaft for rotation therewith, said comminution means axially spaced along the length of said shaft below said pre-breaker means and axially spaced with respect to each other for subsequently and serially impacting the refuse material and the fluid carrier medium upon emergence thereof from the proximity of said pre-breaker means;

e. means coupled to said refuse shredding and grinding means for rotatable driving thereof; and f. means at the discharge section of said housing for controlling the flow rate of refuse materials and the fluid carrier medium at a rate that is substantially equal to the rate of input of the refuse materials and the fluid carrier medium.

2. A centrifugal mill as claimed in claim 1 wherein said pre-breaker means comprises a plurality of substantially rectanguler plates each affixed to said shaft for rotation therewith, each of said plates transverse to the longitudinal axis of said shaft, said plurality of plates disposed in a stacked array longitudinally of said shaft and radially offset with respect to each other to provide a plurality of radially spaced impacting edges.

3. A centrifugal mill as claimed in claim 1 wherein each of said comminution means comprises:

a. a circular disc affixed centrally thereof to said shaft for rotation therewith, said disc disposed in a plane transverse to the longitudinal axis of said shaft; and b. a plurality of radially disposed striker vanes affixed to the upper surface of said disc and extending beyond the periphery thereof.

4. A centrifugal mill as claimed in claim 3 wherein each of said striker vanes comprises an angle iron member having a reinforcing block affixed thereto between the webs thereof.

5. A centrifugal mill as claimed in claim 1 wherein said refuse shredding and grinding means further comprises:

a. said pre-breaker means is affixed to said shaft in a plane transverse to the longitudinal axis of said shaft, said pre-breaker means having a plurality of radially spaced impacting edges formed in the periphery thereof;

b. an endless shelf fixed in the bore of said housing immediately below said pre-breaker means, said shelf circumscribing a central opening which is larger than the peripheral dimension of said pre-breaker means;

c. said pair of comminution means are affixed to said shaft so that each are in a different plane transverse to the longitudinal axis of said shaft; and d. an endless shelf fixed in the bore of said housing immediately below each of said pair of comminution means with each of said shelves circumscribing a central opening which is larger than the peripheral dimension of its respective one of said pair of comminution means.

6. A centrifugal mill as claimed in claim 1 wherein said refuse input port has a normally closed reverse flow checking means mounted therein which will open upon contact of the refuse material entering therethrough into the bore of said housing and will return to the normally closed position in the absence of such contact.

7. A centrifugal mill as claimed in claim 1 wherein said refuse input port has a normally closed reverse flow checking means mounted therein in the form of a pair of oppositely mounted deflectable flaps which are forced open by the refuse material moving therethrough into the bore of said housing and will return to the normally closed position in the absence of such movement of the refuse material.

8. A centrifugal mill as claimed in claim 1 wherein said means in the head section of said housing for injecting a fluid carrier medium includes a port communicating with the interior of said housing through which the fluid carrier medium in the form of an air is injectible.

9. A centrifugal mill as claimed in claim 1 wherein said means in the head section of said housing for injecting a fluid carrier medium includes a port communicating with the interior of said housing through which the fluid carrier medium in the form of air and an aqueous liquid is injectible.

10. A centrifugal mill as claimed in claim 2 wherein said means in the head section of sad housing for injecting a fluid carrier medium includes a port communicating with the interior of said housing through which the fluid carrier medium in the form of air and aqueous sewage is injectible.

11. A centrifugal mill as claimed in claim 1 wherein the discharge section of said housing includes a hopper having an outlet port and having a flow control means coupled to that outlet port for controlling the flow rate therethrough.

12. A centrifugal mill as claimed in claim 1 wherein the discharge section of said housing includes a hopper having an outlet port with a variable speed flow control means coupled to that outlet port for adjustably controlling flow rate therethrough.

13. A centrifugal mill as claimed in claim 1 wherein the discharge section of said housing includes a main hopper having an outlet port with a flow control means coupled thereto, the discharge section of said housing also including an internally concentrically mounted hopper within said main hopper for receiving relatively light weight air classified materials and directing those materials externally of said housing through an outlet duct coupled to said internal hopper, the outlet duct from said internal hopper having a flow control means connected thereto for controlling the flow rate through the outlet duct.

* * * * *